US008889063B2

(12) United States Patent
Karlsson et al.

(10) Patent No.: US 8,889,063 B2
(45) Date of Patent: Nov. 18, 2014

(54) SINTERING FURNACE AND METHOD OF MAKING CUTTING TOOLS

(75) Inventors: Anders Karlsson, Stockholm (SE); Gunilla Anderson, Sollentuna (SE); Peter Björkhagen, Skarpnäck (SE); Per Gustafson, Huddinge (SE); Marco Zwinkels, Sundbyberg (SE)

(73) Assignee: Sandvik Intellectual Property AB, Sandviken (SE)

( * ) Notice: Subject to any disclaimer, the term of this patent is extended or adjusted under 35 U.S.C. 154(b) by 0 days.

(21) Appl. No.: 12/745,305

(22) PCT Filed: Dec. 19, 2008

(86) PCT No.: PCT/SE2008/051525

§ 371 (c)(1),
(2), (4) Date: Sep. 10, 2010

(87) PCT Pub. No.: WO2009/082349

PCT Pub. Date: Jul. 2, 2009

(65) Prior Publication Data

US 2011/0008199 A1 Jan. 13, 2011

(30) Foreign Application Priority Data

Dec. 21, 2007 (SE) ..... 0702911

(51) Int. Cl.

| | |
|---|---|
| ***B22F 3/10*** | (2006.01) |
| ***F27B 17/00*** | (2006.01) |
| ***B22F 3/00*** | (2006.01) |
| *B22F 5/00* | (2006.01) |

(52) U.S. Cl.

CPC ..... *F27B 17/00* (2013.01); *B22F 3/003* (2013.01); *B22F 3/1028* (2013.01); *B22F 2005/001* (2013.01); *B22F 2999/00* (2013.01)

USPC ..... 419/25; 419/26; 419/29

(58) Field of Classification Search

USPC ..... 266/249–264; 419/26, 29

See application file for complete search history.

(56) References Cited

U.S. PATENT DOCUMENTS

| | | | | |
|---|---|---|---|---|
| 4,830,342 | A * | 5/1989 | Boneff | 266/252 |
| 4,851,052 | A * | 7/1989 | Nishioka et al. | 148/546 |

(Continued)

FOREIGN PATENT DOCUMENTS

| | | |
|---|---|---|
| EP | 0 337 696 | 10/1989 |
| EP | 0 603 143 | 6/1994 |

(Continued)

OTHER PUBLICATIONS

Machine translation of JP 11-166791 Wada et al. Retrieved from the JPO website.*

(Continued)

*Primary Examiner* — Aaron Austin
*Assistant Examiner* — Megha Mehta
(74) *Attorney, Agent, or Firm* — Morgan, Lewis & Bockius LLP

(57) ABSTRACT

The present invention relates to a method of making cutting tools comprising a substrate having a hard phase and a binder phase, the method comprising forming green powder compacts using powder metallurgical techniques, charging the green powder compacts, placed on one or several trays, in a furnace and sintering the green powder compacts wherein the furnace comprises an insulation package, at least three individually controlled heating elements located inside the insulation package including a vertical heating element, an upper horizontal heating element arranged in an upper part of the furnace, and a lower horizontal heating element arranged in a lower part of the furnace, wherein operating the at least three heating elements such that an average controlled cooling rate from a sintering temperature down to at least a solidification temperature of the binder phase is 0.1-4.0° C./min, and a sintering furnace operable to obtain a controlled cooling rate.

23 Claims, 3 Drawing Sheets

(56) References Cited

U.S. PATENT DOCUMENTS

| | | | | |
|---|---|---|---|---|
| 5,151,247 | A | | 9/1992 | Haglund et al. |
| 5,414,927 | A | * | 5/1995 | Fiel et al. ..... 29/825 |
| 5,993,970 | A | | 11/1999 | Oscarsson et al. |

FOREIGN PATENT DOCUMENTS

| | | | |
|---|---|---|---|
| EP | 1 468 764 | | 10/2004 |
| JP | 4-297507 | | 10/1992 |
| JP | 5-171442 | | 7/1993 |
| JP | 10-141863 | * | 5/1998 |
| JP | 10-281651 | | 10/1998 |
| JP | 11-166791 | | 6/1999 |
| JP | 2005-002384 | | 1/2005 |

OTHER PUBLICATIONS

Machine translation of JP 10-281651 Kawada. Retrived from the JPO website.*
Human translation of JP 11-166791 Wada et al.*

* cited by examiner

SINTERING FURNACE AND METHOD OF MAKING CUTTING TOOLS

This application is a §371 National Stage Application of PCT International Application No. PCT/SE2008/051525, filed Dec. 19, 2008.

The present invention relates to a method of manufacturing cutting tools for machining operations such as milling, drilling and turning.

Tungsten carbide based alloys, usually referred to as cemented carbides, are used in a wide range of applications; the most important is as materials for cutting tools. In this application the alloy usually comprises a cobalt binder phase and may often contain small amounts of one or more of the group IVa, Va, and VIa elements. Another important material group for cutting tool applications are titanium carbonitride based alloys, usually referred to as cermets. They usually comprise a metallic binder phase of cobalt and/or nickel and contain most often carbides and/or nitrides of one or more of the group IVa, Va and VIa elements.

Substrates for cutting tools of, e.g., cemented carbide or cermet, are produced using powder metallurgical methods. Normally this includes mixing/milling of powders forming binder phase and powders forming hard constituents in a slurry which is subsequently spray dried to a ready-to-press (RTP) powder, pressing the RTP powder into green compacts, and sintering the green compacts into dense cemented carbide or cermet substrates.

The dimension and shape of the substrate is critical for the performance of the tool, but can often deviate from the nominal value due to variations in the above mentioned production steps. The deviation caused by sintering is mainly dependent on type and design of the sintering furnace, the position of the green compacts in the sintering furnace batch, the sintering process and the composition of the substrates. One type of sintering related distortion is warpage of the substrates due to uncontrolled carburization or decarburization reactions between the substrates and their environment, i.e., the support or the gaseous atmosphere in the sintering furnace, cf. U.S. Pat. No. 5,151,247. Another well-known type of sintering distortion is that related to the effect of gravity. Those types of distortion are problematic primarily for large bodies and alloys having high metallic binder content. In production of, e.g., cutting tool inserts, this effect is small and can be compensated for in the press tool design.

Dimensional deviations are conventionally corrected using a post-sintering grinding operation, but this operation gets increasingly more expensive with the magnitude of the fault. For tools that are sintered directly into final dimension and shape, so called direct pressed cutting tools, the distortions can lead to problem with positioning. One example is when mounting a direct pressed cutting tool insert in the tool holder, where a dimensional fault may lead to unpredictable wear behavior and poorer tolerances of the work piece surface.

In U.S. Pat. No. 5,151,247, it is disclosed a way to alleviate the mentioned carburization or decarburization reactions by the use of an inert gas at high pressures during liquid phase sintering. In U.S. Pat. No. 5,993,970 is disclosed that choosing a proper coating for the graphite support trays can minimize the reactions between the substrates and the support.

EP 1,468,764 discloses a method for reducing dimensional deviations of cemented carbide bodies by placing the bodies in a certain orientation on a sintering plate after pressing and performing an isotropic sintering process. Thereby dimensional deformation caused by the sintering process will compensate for deformation caused by the pressing operation.

It is an object of the present invention to provide a method for producing cutting tool substrates of, e.g., cemented carbide or cermet, which alleviates the need for a post-sintering grinding operation.

It has surprisingly been found that it is possible to greatly reduce the dimensional deviation from the nominal values of a cutting tool substrate of, e.g., cemented carbide and cermet, by performing the sintering process under certain conditions. Surprisingly it is also found that a previously undiscovered binder phase content variation, wherein different parts of the sintered substrate material deviate from the nominal composition, is significantly reduced under these sintering conditions. Thus, a cutting tool with dimensions close to nominal and the desired material properties on all cutting edges can be produced by the method according to the invention.

According to the present invention there is provided a method of making cutting tools comprising a substrate of, e.g., cemented carbide or cermet, comprising a hard phase and a binder phase, the method comprising forming green powder compacts using powder metallurgical techniques, charging the green powder compacts, placed on one or several trays, in a furnace and sintering the green powder compacts, to preferably dense substrates, wherein the furnace comprises an insulation package, 9, at least three individually controlled heating elements located inside the insulation package, 9, including a vertical heating element, 5, suitably at least partly enclosing the one or several trays, an upper horizontal heating element, 6, arranged in an upper part of the furnace, and a lower horizontal heating element, 7, arranged in a lower part of the furnace, wherein operating the at least three heating elements such that an average controlled cooling rate from the sintering temperature down to at least the solidification temperature of the binder phase is 0.1-4.0° C./min, preferably 1.5-2.5° C./min.

The invention also provides a sintering furnace comprising an insulation package, 9, at least three individually controlled heating elements located inside the insulation package, 9, including a vertical heating element, 5, suitably at least partly enclosing the one or several trays, an upper horizontal heating element, 6, arranged in an upper part of the furnace, and a lower horizontal heating element, 7, arranged in a lower part of the furnace, wherein the at least three heating elements are operable to obtained an average controlled cooling rate of 0.1-4.0° C./min, preferably 1.5-2.5° C./min.

In one embodiment the method comprises mixing and milling powders forming hard constituents and powders forming a binder phase in a slurry, producing a ready-to-press powder from the slurry by, e.g., spray drying, pressing the ready-to-press powder into green powder compacts and sintering the green powder compacts to dense cemented carbide or cermet substrates.

Figure 1:
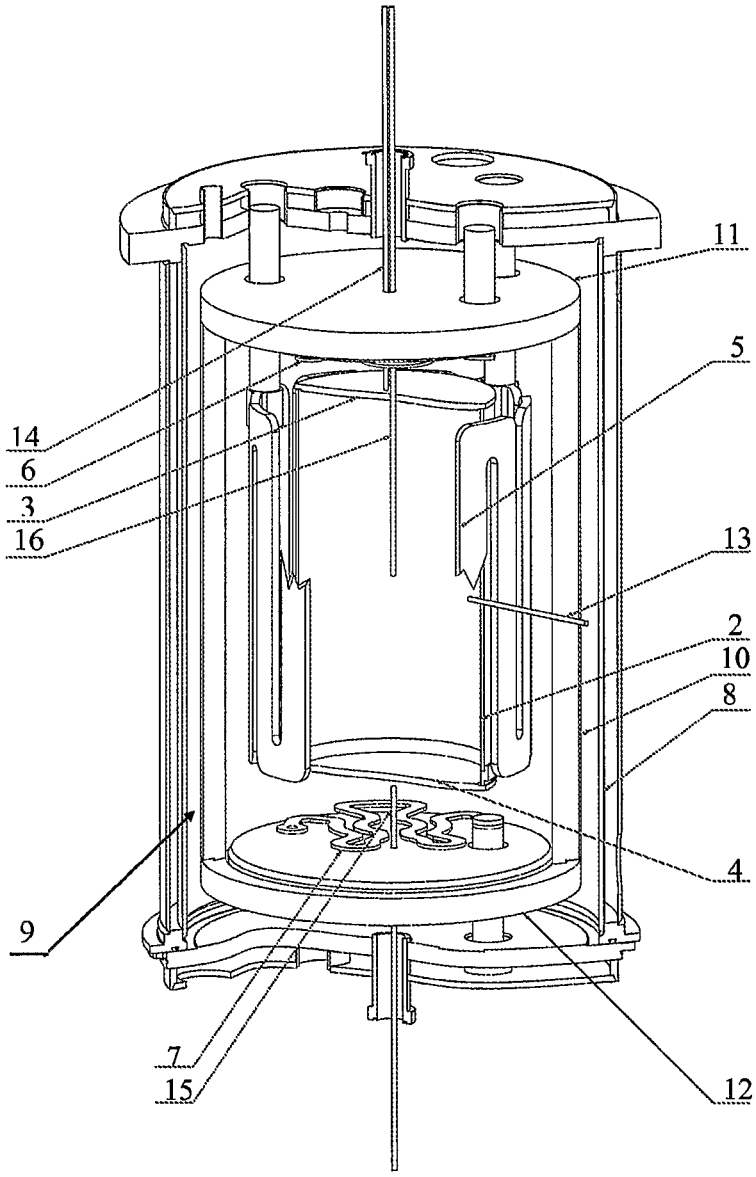
FIG. 1 shows in section an exemplary sintering furnace according to the present invention.

In one embodiment the sintering is conducted in a vertical cylindrical furnace (FIG. 1 and FIG. 2) with one or more of the following specifics. The vertical cylindrical furnace contains one stack of circular graphite trays, 1, with the green powder compacts of, e.g., cemented carbide or cermet, placed on the trays. No specific alignment or rotation of the compacts on the trays before and during sintering is necessary. The sintering furnace comprises an outer essentially cylindrical steel jacket, 8, an essentially cylindrical insulation package, 9, preferably made of graphite, located inside the cylindrical steel jacket, 8, said insulation package, 9, consists of a cylindrical insulation part, 10, a top insulation disc, 11, and a bottom insulation disc, 12, at least three individually controlled heating elements, which can be made of graphite, located inside the insulation package, 9, including a vertical cylindrical heating element, 5, arranged inside the cylindrical insulation part, 10, an upper horizontal heating element, 6, arranged below the upper insulation disc, 11, in an upper part of the furnace, and a lower horizontal heating element, 7, arranged above the lower insulation disc, 12, in a lower part of the furnace. The at least one vertical cylindrical heating element, 5, is surrounding the stack of trays so that the heat flow is symmetric in radial direction of the tray. The vertical heating element has a diameter, D, in the range 150 to 600 mm and preferably 400 to 460 mm. The vertical heating element has a height, H, in the range 50 to 1000 mm and preferably 530 to 630 mm. Furthermore the upper horizontal heating element, 6, is located above the top tray and the lower horizontal heating element, 7, is located below the bottom tray. The extension in horizontal direction of the upper heating element, 6, and the lower heating element, 7, is less than the diameter, D, of the vertical cylindrical heating element, 5.

Further in a preferred embodiment, at least three separate thermocouples, including a middle thermocouple, 13, an upper thermocouple, 14, and a lower thermocouple, 15, located close to the vertical cylindrical heating element, 5, the upper horizontal heating element, 6, and the lower horizontal heating element, 7, respectively, are used to monitor the temperature in the furnace and control the heating zones.

One additional thermocouple, 16, may be positioned in the middle of the furnace batch very close to the material to be sintered. This thermocouple gives important information of the process, particularly during debinding and solidification steps, where the heat of reaction from the substrate binder phase can be monitored.

Furthermore during the sintering process, particularly during the controlled cooling from sintering temperature down to at least the solidification temperature, the difference between the additional thermocouple, 16, and the middle thermocouple, 13, can optionally be used as a set parameter in the control system, which is not allowed to be exceeded during the process. This type of regulation in the control system is aimed to minimize the temperature gradients in the radial direction over the tray.

The sintering trays preferably have a diameter in the range, 0.25*D to 0.99*D, more preferably 0.55*D to 0.80*D and most preferably 0.65*D to 0.70*D, where D is the diameter of the vertical cylindrical heating element, 5. The stack of trays preferably have a height in the range 0.01*H to 1.0*H, more preferably 0.85*H to 0.95*H, where H is the height of the vertical cylindrical heating element, 5.

In a preferred embodiment, the insulation package, 9, enclosing the at least three heating elements, is made of graphite and has the following dimensions. The cylindrical insulation part, 10, has an inner diameter in the range 1.04*D to 2.0*D, preferably 1.15*D to 1.35*D, where D is the diameter of the vertical cylindrical heating element, 5, and a height of 1.1*H to 2.5*H, preferably 1.7*H to 2.1*H, where H is the height of the vertical cylindrical heating element, 5. The cylindrical insulation part, 10, has a thickness in the range 20 to 60 mm, preferably 35-45 mm. The top insulation disc, 11, and the bottom insulation disc, 12, have a thickness in the range 35-85 mm, preferably 55-65 mm. The outer part of the furnace, the essentially cylindrical steel jacket, 8, is water cooled.

Figure 2:
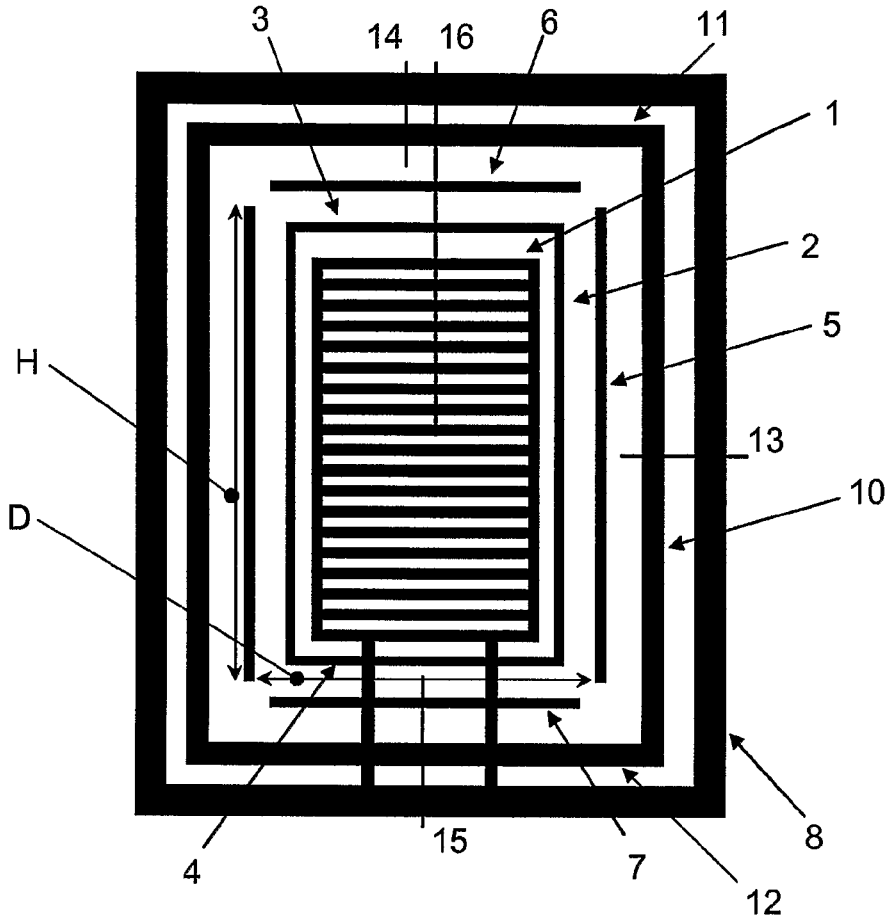
FIG. 2 shows two different side views of an exemplary sintering furnace according to the present invention.
Figure 2:
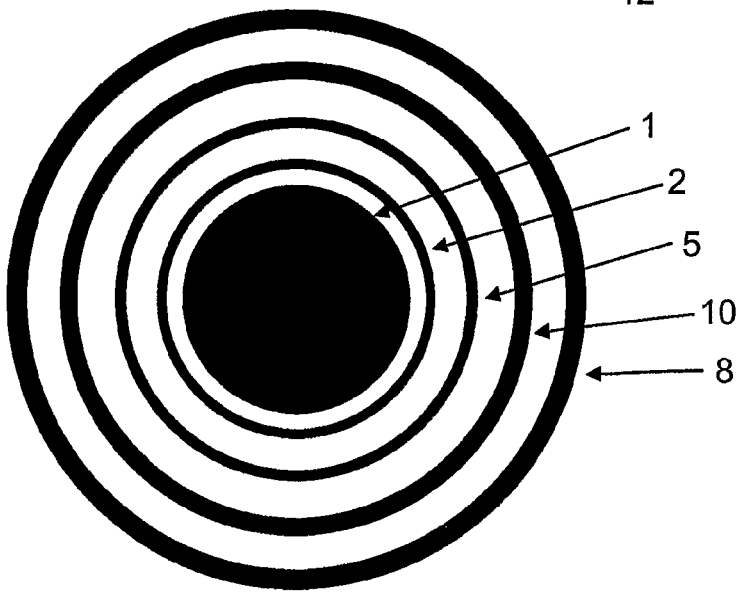

In another embodiment, the stack of trays are enclosed in a cylindrical graphite retort consisting of three parts, a retort cylinder, 2, retort top plate, 3, and retort bottom plate, 4. The retort is located between the at least three heating elements, 5, 6, 7, and the stack of trays, 1, to get improved control of the temperature gradients in the furnace during cooling. The retort cylinder, 2, has an inner diameter of 0.30*D to 0.99*D, preferably 0.70*D to 0.78*D, where D is the diameter of the vertical cylindrical heating element, 5. The graphite retort is normally closed by the retort top plate, 3, and the retort bottom plate, 4, as indicated in FIG. 2, but the plates can be opened, for example to enhance the fast cooling process. The retort cylinder, 2, the retort top plate, 3, and the retort bottom plate, 4, have a wall thickness of 5 to 20 mm, preferably 7 to 8 mm.

The dimensions and material properties of insulation and retort are combined so that an average free cooling rate in the temperature range from 1400° C. down to 1200° C. in an empty furnace, i.e., without any graphite trays, is in the range 9 to 14° C./min. The cooling rate is determined from an average temperature from the middle thermocouple, 13, the upper thermocouple, 14, and the lower thermocouple, 15.

The sintering cycle has a first part in temperature range 20-450° C. being a debinding step aimed to remove the organic lubricant of the green compact. This step is followed by vacuum heating step up to the sintering temperature, which is in the range 1350-1550° C., depending on the composition of the substrates. The third step, the actual sintering, is performed at a total pressure between 0.001 mbar and 900 mbar. At the end of the sintering process a high pressure gas in the range between 20 and 100 bars can optionally be introduced to avoid unwanted defects and enhance densification of the material. During these three process steps, a significant part of the heat to the charge is generated by the lower horizontal heating element, 7, in order to obtain good temperature uniformity throughout the charge in vertical direction.

The sintering step is followed by a controlled cooling step from the sintering temperature down to at least the solidification temperature of the binder phase in the batch. The average controlled cooling rate is in the range 0.1 to 4.0° C./min, preferably 1.5 to 2.5° C./min, to minimize temperature gradients over individual substrates at solidification. The controlled cooling rate, measured by the at least three separate thermocouples, including the middle thermocouple, 13, the upper thermocouple, 14, and the lower thermocouple, 15, is achieved by applying power from the at least three individually controlled heating elements including the vertical cylindrical heating element, 5, the upper horizontal heating element, 6, and the lower horizontal heating element, 7. The distribution of the total power between the at least three heating elements has an influence of the temperature gradients over trays in radial direction. By applying more than 70% of the total power from the vertical cylindrical heating element, 5, the temperature gradients over the trays in radial direction can be reduced. A further improvement is achieved when applying 100% of the power from the vertical cylindrical element, 5, thus shutting off the upper horizontal heating element, 6, and the lower horizontal heating element, 7, during the controlled cooling step.

The solidification of the binder phase of the substrate, which is an exothermic reaction, and critical with regards the creation of dimensional deviations, can be monitored by the middle thermocouple, 16. To be able to use the middle thermocouple, 16, in the middle of the batch, and keep the radial symmetry, sintering trays with a centered hole is needed. After all binder phase in the batch has solidified, which can be observed from the middle thermocouple, 16, a fast cooling step can start immediately in order to reduce the total sintering process time, without negatively affecting the material and dimensional properties of the substrates.

The described sintering furnace and process is foremost used for sintering of cemented carbide and cermets grades with higher binder phase content than 13 volume-% Co and/or Ni. For grades with this composition, the benefits of reduced dimensional deviations and reduced binder phase content variations compared to conventional sintering methods are significant. The invention can also be used for grades below the specified binder phase content limit, but then a less significant improvement can be observed compared to conventional sintering methods.

The invention can be applied on grades with Com/Co, i.e., wt-% magnetic cobalt/wt-% Co in the cemented carbide or cermet, within all the allowed ranges for cutting tool products. However, the benefit of reducing dimensional deviations and reduced binder phase content variations compared to conventional sintering is more significant when Com/Co is below 0.95.

The described sintering furnace and process are used for producing cutting tools having all types of sizes and geometries. However, different types of measures are needed to characterize the dimensional deviation for different geometries, such as square, rhombic, round, triangular etc. Since the sintering related distortions are dependent of insert sizes, the use of the invention has been found to be more advantageous on larger inserts in order to reduce the absolute distortion considerably.

The invention can be illustrated by sintering a batch of SNMM-15 green compacts with a grade having a composition of binder phase over 13 volume % Co and/or Ni. The square shape of SNMM is chosen because the dimensional distortion and binder phase variation is easy to measure on this geometry. The sintering is performed using the furnace and sintering process according to the invention. After sintering, 16 substrates, no. 1 to no. 16, from one tray are sampled from the positions according to FIG. 3. The four side lengths of each body, S1 to S4 (FIG. 3), are measured and differences in side length between opposite sides are calculated: $d_{24}$=(S2−S4) and $d_{31}$=(S3−S1). The variation of $d_{24}$ and $d_{31}$ between the 16 substrates is less than ±25 μm using the sintering furnace and process according to the invention. In order to illustrate the binder phase variation substrate no. 1 and no. 9 (FIG. 3) is cut into nine parts, see FIG. 4. The Co content is measured on the substrates using chemical analysis. The difference between the highest and the lowest cobalt content from the four parts B1-B4 within substrate no. 1 and no. 9 is less than 0.20 wt-% using the sintering furnace and process according to the invention.

EXAMPLE 1

A powder mixture of a commercially available cemented carbide grade with nominal composition (wt-%) 11.50% Co, 81.61% W, 1.17% Ta, 0.28% Nb was prepared by wet milling of WC, Co, TaC and $Ta_{0.8}Nb_{0.2}C$. The powder was spray dried and pressed into square green compacts of geometry SNMM-15 with a nominal sintered side length of 15 mm. The powder properties and pressing cycle was chosen so that variation in powder density in the body was minimized, thus reducing shape distortion caused by powder and pressing process. After pressing the green compacts were placed on circular sintering trays with diameter 290 mm according to normal procedure. Approximately 72 green compacts were placed on each sintering tray, see FIG. 3. No specific rotation or alignment of the green compacts on the tray was used.

EXAMPLE 2

Invention

The pressed compacts from Example 1 were sintered in a vertical cylindrical furnace on totally 50 sintering trays with diameter 290 mm forming a stack height of 600 mm. The tray material was isostatically pressed graphite. The cylindrical heating element of the furnace had a diameter of 430 mm, height of 580 mm and thickness of 15 mm. There was also a heating element at the top and bottom, both with thickness of 15 mm. Between the heating element and stack of graphite trays, there was a graphite retort where the top and bottom plate were closed during the entire process. The cylindrical retort had an inner diameter of 310 mm, height of 580 mm and a thickness of 7.5 mm. The top and bottom plate of the retort also had a thickness of 7.5 mm. The cylindrical insulation, positioned outside the retort, had an internal diameter of 540 mm and height of 1150 mm. The thickness of the cylindrical insulation was 40 mm, whereas the thickness of the top and bottom part was 80 mm.

The green compacts were first debinded in the temperature range 20-450° C. This step was followed by a vacuum step at 60 minutes where the temperature was raised to the sintering temperature 1410° C. The sintering was performed at 1410° C. for 60 minutes using an atmosphere consisting of Ar and CO at a total pressure of 40 mbar. At these process steps the power distribution between the heating elements was approximately: cylindrical element 55%, bottom element 25% and top element 20%.

After the sintering step, there was a controlled cooling step at a rate of 2° C./min between 1410° C. and 1200° C. with an atmosphere consisting of Ar and CO at a total pressure of 40 mbar. At this step the bottom and top element was shut off, thus all heat was generated by the cylindrical element. After sintering, substrates no. 1 to no. 16 from a sintering tray positioned in the middle of the charge was sampled for analyses, see FIG. 3. These substrates are referred to as sample A.

EXAMPLE 3

Invention

The pressed compacts from Example 1 were sintered in a vertical cylindrical furnace on totally 50 sintering trays with diameter 290 mm forming a stack height of 600 mm. The tray material was isostatically pressed graphite. The cylindrical heating element of the furnace had a diameter of 430 mm, height of 580 mm and thickness of 15 mm. There was also a heating element at the top and bottom, both with thickness of 15 mm. Between the heating element and stack of graphite trays, there was a graphite retort where the top and bottom plate were closed during the entire process. The cylindrical retort had an inner diameter of 310 mm, height of 580 mm and a thickness of 7.5 mm. The top and bottom plate of the retort also had a thickness of 7.5 mm. The cylindrical insulation, positioned outside the retort, had an internal diameter of 540 mm and height of 1150 mm. The thickness of the cylindrical insulation was 40 mm, whereas the thickness of the top and bottom part was 80 mm.

The green compacts were first debinded in the temperature range 20-450° C. This step was followed by a vacuum step at 60 minutes where the temperature was raised to the sintering temperature 1410° C. The sintering was performed at 1410°

C. for 60 minutes using an atmosphere consisting of Ar and CO at a total pressure of 40 mbar. At these process steps the power distribution between the heating elements was approximately: cylindrical element 55%, bottom element 25% and top element 20%.

After the sintering step, there was a controlled cooling step at a rate of 2° C./min between 1410° C. and 1200° C. with an atmosphere consisting of Ar and CO at a total pressure of 40 mbar. At this step the power distribution between the heating elements were cylindrical element 70%, bottom element 25% and top element 5%. After sintering, substrates no. 1 to no. 16 from a sintering tray positioned in the middle of the charge was sampled for analyses, see FIG. 3. These substrates are referred to as sample B.

EXAMPLE 4

Invention

The pressed compacts from Example 1 were sintered in a vertical cylindrical furnace on totally 50 sintering trays with diameter 290 mm forming a stack height of 600 mm. The tray material was isostatically pressed graphite. The cylindrical heating element of the furnace had a diameter of 430 mm, height of 580 mm and thickness of 15 mm. There was also a heating element at the top and bottom, both with thickness of 15 mm. The cylindrical insulation had an internal diameter of 540 mm and height of 1150 mm. The thickness of the cylindrical insulation was 40 mm, whereas the thickness of the top and bottom part was 80 mm.

The green compacts were first debinded in the temperature range 20-450° C. This step was followed by a vacuum step at 60 minutes where the temperature was raised to the sintering temperature 1410° C. The sintering was performed at 1410° C. for 60 minutes using an atmosphere consisting of Ar and CO at a total pressure of 40 mbar. At these process steps the power distribution between the heating elements was approximately: cylindrical element 55%, bottom element 25% and top element 20%.

After the sintering step, there was a controlled cooling step at a rate of 2° C./min between 1410° C. and 1200° C. with an atmosphere consisting of Ar and CO at a total pressure of 40 mbar. At this step the power distribution between the heating elements were cylindrical element 25%, bottom element 35% and top element 40%. After sintering, substrates no. 1 to no. 16 from a sintering tray positioned in the middle of the charge was sampled for analyses, see FIG. 3. These substrates are referred to as sample C.

EXAMPLE 5

Invention

The pressed compacts from Example 1 were sintered in a vertical cylindrical furnace on totally 50 sintering trays with diameter 290 mm forming a stack height of 600 mm. The tray material was isostatically pressed graphite. The cylindrical heating element of the furnace had a diameter of 430 mm, height of 580 mm and thickness of 15 mm. There was also a heating element at the top and bottom, both with thickness of 15 mm. Between the heating element and stack of graphite trays, there was a graphite retort where the top and bottom plate were closed during the entire process. The cylindrical retort had an inner diameter of 310 mm, height of 580 mm and a thickness of 7.5 mm. The top and bottom plate of the retort also had a thickness of 7.5 mm. The cylindrical insulation, positioned outside the retort, had an internal diameter of 540 mm and height of 1150 mm. The thickness of the cylindrical insulation was 40 mm, whereas the thickness of the top and bottom part was 80 mm.

The green compacts were first debinded in the temperature range 20-450° C. This step was followed by a vacuum step at 60 minutes where the temperature was raised to the sintering temperature 1410° C. The sintering was performed at 1410° C. for 60 minutes using an atmosphere consisting of Ar and CO at a total pressure of 40 mbar. At these process steps the power distribution between the heating elements was approximately: cylindrical element 55%, bottom element 25% and top element 20%.

After the sintering step, there was a controlled cooling step at a rate of 4° C./min between 1410° C. and 1200° C. with an atmosphere consisting of Ar and CO at a total pressure of 40 mbar. At this step the power distribution between the heating elements were cylindrical element 25%, bottom element 35% and top element 40%. After sintering, substrates no. 1 to no. 16 from a sintering tray positioned in the middle of the charge was sampled for analyses, see FIG. 3. These substrates are referred to as sample D.

EXAMPLE 6

Comparative

The pressed compacts from Example 1 were sintered in a vertical cylindrical furnace on totally 50 sintering trays with diameter 290 mm forming a stack height of 600 mm. The tray material was isostatically pressed graphite. The cylindrical heating element of the furnace had a diameter of 430 mm, height of 580 mm and thickness of 15 mm. There was also a heating element at the top and bottom, both with thickness of 15 mm. The cylindrical insulation had an internal diameter of 540 mm and height of 1150 mm. The thickness of the cylindrical insulation was 40 mm, whereas the thickness of the top and bottom part was 80 mm.

The green compacts were first debinded in the temperature range 20-450° C. This step was followed by a vacuum step at 60 minutes where the temperature was raised to the sintering temperature 1410° C. The sintering was performed at 1410° C. for 60 minutes using an atmosphere consisting of Ar and CO at a total pressure of 40 mbar. At these process steps the power distribution between the heating elements was approximately: cylindrical element 55%, bottom element 25% and top element 20%.

After the sintering step, the charge was allowed to cool freely from the sintering temperature to 1200° C. at an average rate of 9° C./min. After sintering, substrates no. 1 to no. 16 from a sintering tray positioned in the middle of the charge was sampled for analyses, see FIG. 3. These substrates are referred to as sample E.

EXAMPLE 7

Figure 4:
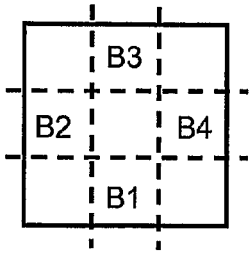
FIG. 4 shows schematically a cutting tool insert sectioned in parts B1-B4.

On all 16 substrates from sample A-E, the side lengths of side 1, 2, 3 and 4 (S1-S4) were measured using a coordinate measuring machine, see FIG. 4. The differences in side lengths between opposite sides, $d_{24}$ and $d_{31}$, were calculated according to $d_{24}$=(S2−S4) and $d_{31}$=(S3−S1). The variation in side length over sintering tray can be expressed as range between max and min values for d24 and d31:

$$\Delta d_{24max\text{-}min}=\max(d_{24})-\min(d_{24})$$

$$\Delta d_{31max\text{-}min}=\max(d_{31})-\min(d_{31})$$

The obtained values for $\Delta d24_{max\text{-}min}$ and $\Delta d31_{max\text{-}min}$ are shown in Table 1 for sample A-E. Since these values corresponds to dimensional distortion caused by sintering process and furnace, its desirable to minimize them, which is achieved for sample A-D in comparison with sample E.

TABLE 1

| Sample | $\Delta d_{24max-min}$ | $\Delta d_{31max-min}$ |
|---|---|---|
| A | 16 | 33 |
| B | 28 | 32 |
| C | 33 | 39 |
| D | 26 | 47 |
| E | 70 | 66 |

After the dimensional measurements substrate no. 1 and no. 9 from sample A, D and E were cut into 9 parts according to FIG. 5. The cobalt content of the parts B1-B4 was determined using X-ray fluorescence spectrometry. The method uses a calibration curve in the range 0.98-25% of cobalt content and takes into account the effect of other elements normally present in cemented carbide, such as Ti, Cr, Fe, Ni, Nb, Mo, Ta, W, Zr, V and Mn. From three repeated measurements on each sample the error of the method was determined to ±0.02% Co.

The difference between the highest and the lowest cobalt content from the four parts B1-B4 within a substrate was used as a variable to quantify the cobalt content variation within the substrate. In Table 2, the cobalt content variation for sample A, D and E is shown. The cobalt content variation is significantly smaller for sample A and D compared to sample E. The Co variation within the substrates correlates to the position on the sintering tray, so that the part of the substrate oriented towards the periphery of the tray has a higher Co content compared to the part oriented towards the middle of the tray.

TABLE 2

| Sample | Cobalt content variation, substrate no. 1 (wt-%) | Cobalt content variation, substrate no. 9 (wt-%) |
|---|---|---|
| A | 0.12 | 0.16 |
| D | 0.18 | 0.11 |
| E | 0.29 | 0.36 |

EXAMPLE 8

A batch of green powder compacts was manufactured with the same composition and processes as described in Example 1. After pressing the green powder compacts were placed on circular sintering trays with diameter 290 mm according to normal procedure. Approximately 72 green powder compacts were placed on each sintering tray, see FIG. 3.

EXAMPLE 9

Invention

The pressed compacts from Example 8 were sintered in a vertical cylindrical furnace on totally 50 sintering trays with diameter 290 mm forming a stack height of 600 mm. The tray material was isostatically pressed graphite. The cylindrical heating element of the furnace had a diameter of 430 mm, height of 580 mm and thickness of 15 mm. There was also a heating element at the top and bottom, both with thickness of 15 mm. Between the heating element and stack of graphite trays, there was a graphite retort where the top and bottom plate were closed during the entire process. The cylindrical retort had an inner diameter of 310 mm, height of 580 mm and a thickness of 7.5 mm. The top and bottom plate of the retort also had a thickness of 7.5 mm. The cylindrical insulation, positioned outside the retort, had an internal diameter of 540 mm and height of 1150 mm. The thickness of the cylindrical insulation was 40 mm, whereas the thickness of the top and bottom part was 80 mm.

The green compacts were first debinded in the temperature range 20-450° C. This step was followed by a vacuum step at 60 minutes where the temperature was raised to the sintering temperature 1410° C. The sintering was performed at 1410° C. for 60 minutes using an atmosphere consisting of Ar and CO at a total pressure of 40 mbar.

After the sintering step, there was a controlled cooling step at a rate of 2° C./min between 1410° C. and 1200° C. with an atmosphere consisting of Ar and CO at a total pressure of 40 mbar. After sintering, substrates no. 1 to no. 16 from a sintering tray positioned in the middle of the charge was sampled for analyses, see FIG. 3. These substrates are referred to as sample F.

EXAMPLE 10

Invention

The pressed compacts from Example 8 were sintered in a vertical cylindrical furnace on totally 50 sintering trays with diameter 290 mm forming a stack height of 600 mm. The tray material was isostatically pressed graphite. The cylindrical heating element of the furnace had a diameter of 430 mm, height of 580 mm and thickness of 15 mm. There was also a heating element at the top and bottom, both with thickness of 15 mm. Between the heating element and stack of graphite trays, there was a graphite retort where the top and bottom plate were closed during the entire process. The cylindrical retort had an inner diameter of 310 mm, height of 580 mm and a thickness of 7.5 mm. The top and bottom plate of the retort also had a thickness of 7.5 mm. The cylindrical insulation, positioned outside the retort, had an internal diameter of 530 mm and height of 1150 mm. The thickness of the cylindrical insulation was 52 mm, whereas the thickness of the top part was 140 mm and bottom part was 98 mm.

The green compacts were first debinded in the temperature range 20-450° C. This step was followed by a vacuum step at 60 minutes where the temperature was raised to the sintering temperature 1410° C. The sintering was performed at 1410° C. for 60 minutes using an atmosphere consisting of Ar and CO at a total pressure of 40 mbar.

After the sintering step, there was a controlled cooling step at a rate of 2° C./min between 1410° C. and 1200° C. with an atmosphere consisting of Ar and CO at a total pressure of 40 mbar.

Figure 3:
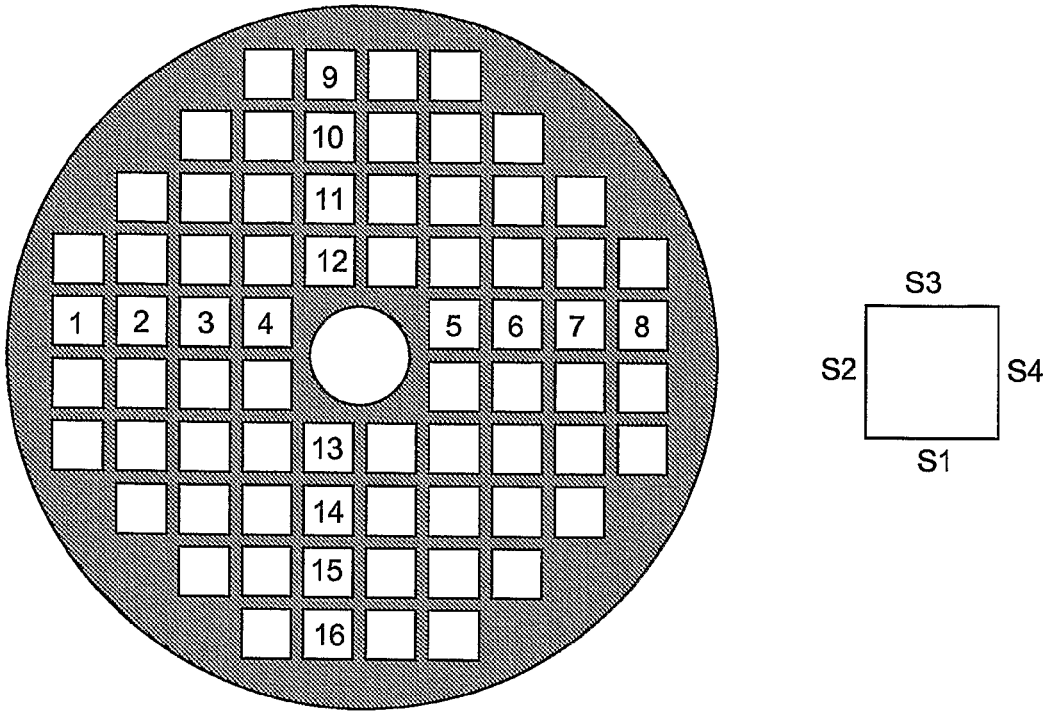
FIG. 3 shows schematically a sintering tray with cutting tool substrates (left) and a substrate with sides S1-S4 (right).

After sintering, substrates no. 1 to no. 16 from a sintering tray positioned in the middle of the charge was sampled for analyses, see FIG. 3. These substrates are referred to as sample G.

EXAMPLE 11

On all 16 substrates from sample F and G, the side lengths of side 1, 2, 3 and 4 (S1-S4) were measured and the differences in side lengths between opposite sides, $d_{24}$ and $d_{31}$, were calculated according to $d_{24}$=(S2−S4) and $d_{31}$=(S3−S1). The variation in side length over sintering tray can be expressed as range between max and min values for d24 and d31:

$$\Delta d_{24max-min}=\max(d_{24})-\min(d_{24})$$

$$\Delta d_{31max-min}=\max(d_{31})-\min(d_{31})$$

The obtained values for $\Delta d24_{max-min}$ and $\Delta d31_{max-min}$ are shown in Table 3 for sample F and G.

TABLE 3

| Sample | $\Delta d_{24max-min}$ | $\Delta d_{31max-min}$ |
|---|---|---|
| F | 30 | 24 |
| G | 43 | 47 |

The invention claimed is:

1. A method of making cutting tools comprising a substrate comprising a hard phase and a binder phase, the method comprising:

forming green powder compacts using powder metallurgical techniques;

charging the green powder compacts, placed on one or several trays, in a furnace; and sintering the green powder compacts, wherein the furnace comprises an insulation package, at least three individually controlled heating elements located inside the insulation package including a vertical heating element, an upper horizontal heating element arranged in an upper part of the furnace, and a lower horizontal heating element arranged in a lower part of the furnace, wherein sintering comprises a cooling step in which each of the at least three heating elements are individually operated and more than 70% of the total power is applied from the vertical cylindrical heating element such that an average controlled cooling rate from a sintering temperature down to at least a solidification temperature of the binder phase is 0.1-4.0° C./min while a temperature gradient over any one tray in a radial direction is minimized, and wherein the furnace further comprises a thermocouple extending vertically through the center of the furnace through a center hole of the one or the several trays such that the one or the several trays are radially symmetrical about the thermocouple, the thermocouple thereby monitoring the solidification of the binder phase.

2. The method according to claim 1 wherein an average controlled cooling rate from the sintering temperature down to at least the solidification temperature is 1.5-2.5° C./min.

3. The method according to claim 1 wherein said vertical heating element at least partly encloses the one or several trays.

4. The method according to claim 1 wherein said furnace is a vertical cylindrical furnace.

5. The method according to claim 1 wherein the vertical heating element is a vertical cylindrical heating element having a diameter, D, in the range 150 to 600 mm, and the vertical heating element has a height, H, in the range 50 to 1000 mm.

6. The method according to claim 1 wherein said insulation package consists of a cylindrical insulation part, a top insulation disc and a bottom insulation disc.

7. The method according to claim 6 wherein the cylindrical insulation part has a thickness in the range 20 to 60 mm, and the top insulation disc and the bottom insulation disc having a thickness in the range 35 to 85 mm.

8. The method according to claim 6 wherein the cylindrical insulation part has an inner diameter in the range 1.04*D to 2.0*D, where D is the diameter of the vertical cylindrical heating element and a height of 1.1*H to 2.5*H, where H is the height of the vertical cylindrical heating element.

9. The method according to claim 1 wherein the furnace has at least three separate thermocouples, including a middle thermocouple, an upper thermocouple and a lower thermocouple located close to the vertical cylindrical heating element, the upper horizontal heating element and the lower horizontal heating element, respectively.

10. The method according to claim 1 wherein the one or several trays is enclosed in a cylindrical graphite retort consisting of three parts, a retort cylinder, retort top plate and retort bottom plate.

11. The method according to claim 1 wherein said furnace has an average free cooling rate in the temperature range from 1400° C. down to 1200° C. in an empty furnace is in the range 9 to 14° C./min.

12. The method according to claim 1 wherein after the thermocouple detects that all the binder phase has solidified in the cooling step, a second cooling step starts which is faster than that occurring during solidification of the binder phase.

13. The method according to claim 5 wherein the diameter, D, is in the range 400 to 460 mm.

14. The method according to claim 5 wherein the height, H, is in the range 530 to 630 mm.

15. The method according to claim 7 wherein the thickness of the cylindrical insulation part is in the range 35 to 45 mm.

16. The method according to claim 7 wherein the thickness of the bottom insulation disc is in the range 55 to 65 mm.

17. The method according to claim 8 wherein the inner diameter of the cylindrical insulation part is in the range 1.15*D to 1.35*D.

18. The method according to claim 8 wherein the height of the cylindrical insulation part is 1.7*H to 2.1*H.

19. The method according to claim 1, wherein the three heating elements are individually operated to reduce temperature gradients in the radial direction.

20. A method of making cutting tools comprising a substrate comprising a hard phase and a binder phase, the method comprising:

forming green powder compacts using powder metallurgical techniques;

charging the green powder compacts, placed on one or several trays, in a furnace; and sintering the green powder compacts, wherein the furnace comprises an insulation package, at least three individually controlled heating elements located inside the insulation package including a vertical heating element, an upper horizontal heating element arranged in an upper part of the furnace, and a lower horizontal heating element arranged in a lower part of the furnace, wherein sintering comprises a cooling step in which the upper horizontal heating element and the lower horizontal heating element are both shut off and 100% of the total applied power is applied from the vertical cylindrical heating element such that an average controlled cooling rate from a sintering temperature down to at least a solidification temperature of the binder phase is 0.1-4.0° C./min while a temperature gradient over any one tray in a radial direction is minimized and wherein the furnace further comprises a thermocouple extending vertically through the center of the furnace through a center hole of the one or the several trays such that the one or the several trays are radially symmetrical about the thermocouple, the thermocouple thereby monitoring the solidification of the binder phase.

21. The method according to claim 12 wherein the thermocouple is positioned in the middle of the green powder compacts during the sintering such that the green powder compacts are radially symmetrical about the thermocouple.

22. The method according to claim 20 wherein after the thermocouple detects that all the binder phase has solidified in the cooling step, a second cooling step starts which is faster than that occurring during solidification of the binder phase.

23. The method according to claim 22 wherein thermocouple is positioned in the middle of the green powder compacts during the sintering such that the green powder compacts are radially symmetrical about the thermocouple.

* * * * *